United States Patent [19]

Rizzitiello

[11] Patent Number: 4,960,149

[45] Date of Patent: Oct. 2, 1990

[54] ASPIRATOR FOR LIQUID AND SOLID SUBSTANCES, WITH SECTIONAL STORAGE BIN

[75] Inventor: Gilberto Rizzitiello, Milan, Italy

[73] Assignee: F.A.D.I. Fabrica Aspirapolvere Domestic Industriali, Milan, Italy

[21] Appl. No.: 383,716

[22] Filed: Jul. 24, 1989

[51] Int. Cl.[5] ..... B65D 6/00; A47L 5/00

[52] U.S. Cl. ..... 137/205; 220/5 R

[58] Field of Search ..... 137/205; 220/4 A, 4 C, 220/5 R, 5 A; 15/300 R, 328

[56] References Cited

U.S. PATENT DOCUMENTS

| | | | |
|---|---|---|---|
| 2,665,663 | 1/1954 | Rawson | 220/5 R |
| 2,666,498 | 1/1954 | Petersen | 137/205 |
| 3,193,129 | 7/1965 | Pfluger | 220/5 R |
| 4,577,650 | 3/1986 | McConnell | 220/4 C |

FOREIGN PATENT DOCUMENTS

| | | | |
|---|---|---|---|
| 712011 | 7/1954 | United Kingdom | 220/4 A |

*Primary Examiner*—Alan Cohan

*Attorney, Agent, or Firm*—Shlesinger, Fitzsimmons & Shlesinger

[57] ABSTRACT

An aspirator comprising a suction head fitted onto the top of a wheel-mounted bin designed to contain the aspirated material. The bin is composed of a bottom section carrying said wheels and of one or more intermediate sections open from above and below which can be stacked and removably secured together so as to form, together with the bottom section, a bin of variable vertical dimensions.

2 Claims, 1 Drawing Sheet

ASPIRATOR FOR LIQUID AND SOLID SUBSTANCES, WITH SECTIONAL STORAGE BIN

There are known aspirators for solid and liquid substances, composed of a wheel-mounted bin for collecting the aspirated material, which is open at the upper end and removably fitted, in the form of a cover, with a head carrying the motor and the suction devices connected thereto.

In order to fulfill the various requirements of their customers, manufacturers produce these aspirators in various models which differ from one another in suction power as well as in the dimensions of the bin which define the maximum quantity of material that can be suctioned before it becomes necessary to empty the bin.

In order to minimize production costs, the different models are obtained by using a standard suction head for each required suction power and fitting it onto a bin of a different height according to the required capacity.

This solution enables them to standardize the production of the suction heads, but forces them to produces a considerable variety of bins, which bears heavily on production, storage and distribution costs.

The scope of this invention is to overcome the above-mentioned problems by providing an aspirator whose capacity can be easily adapted to suit the various requirements.

In view of such scope, an aspirator for solid and liquid substances is provided, of the type comprising a head supporting an electric motor driven suction device removably secured to the upper open end of a wheel-mounted bin, and a suction hose communicating with the inside of said bin, characterized by the fact that said bin is composed of a bottom section which carriers the wheels on its undersurface and of one or more intermediate sections, open from below and above, which can be stacked one on top of the other and removably secured together and to said bottom section by means of fasteners to form said bin.

The innovatory principles of this invention and its advantages over the known technique will be more clearly understood from the following description of a possible embodiment applying such principles, given by way of example, with reference to the accompanying drawings, in which.

Figure 1:
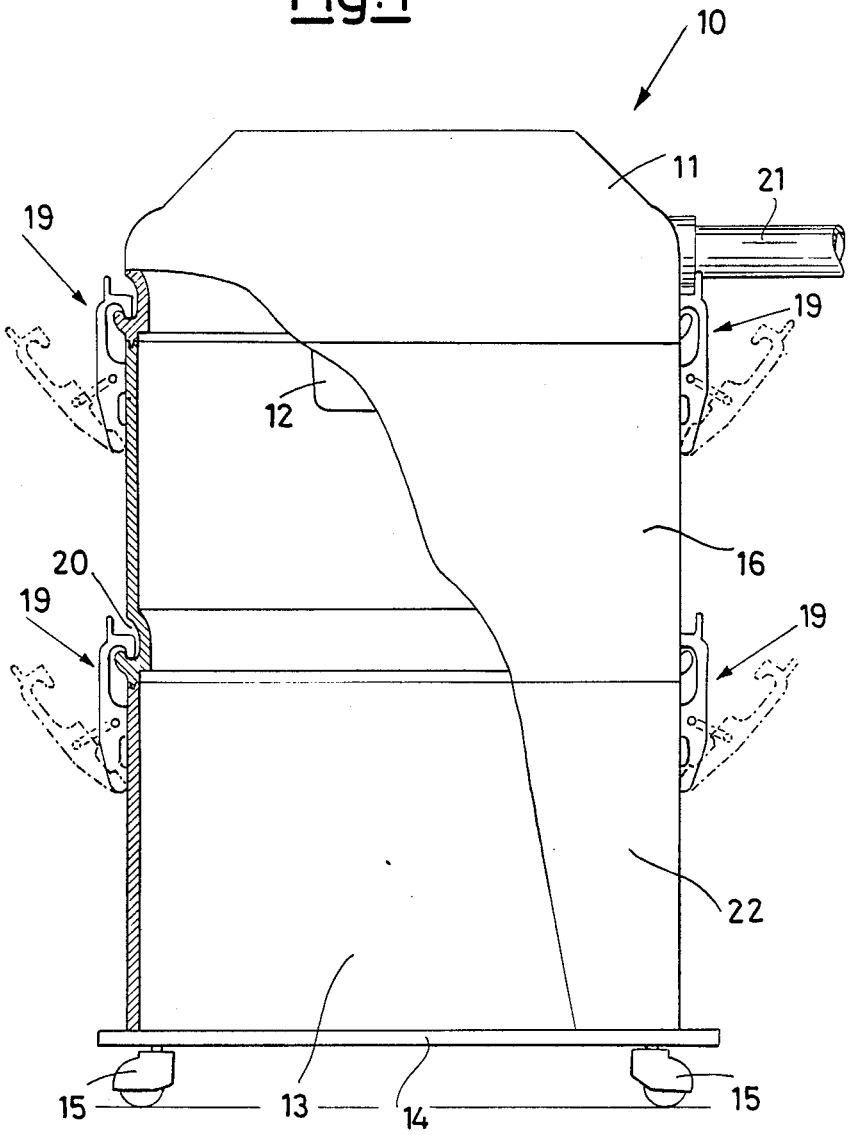
FIG. 1 shows a schematic, side elevation, partial cutaway view of an aspirator according to the invention.
Figure 2:
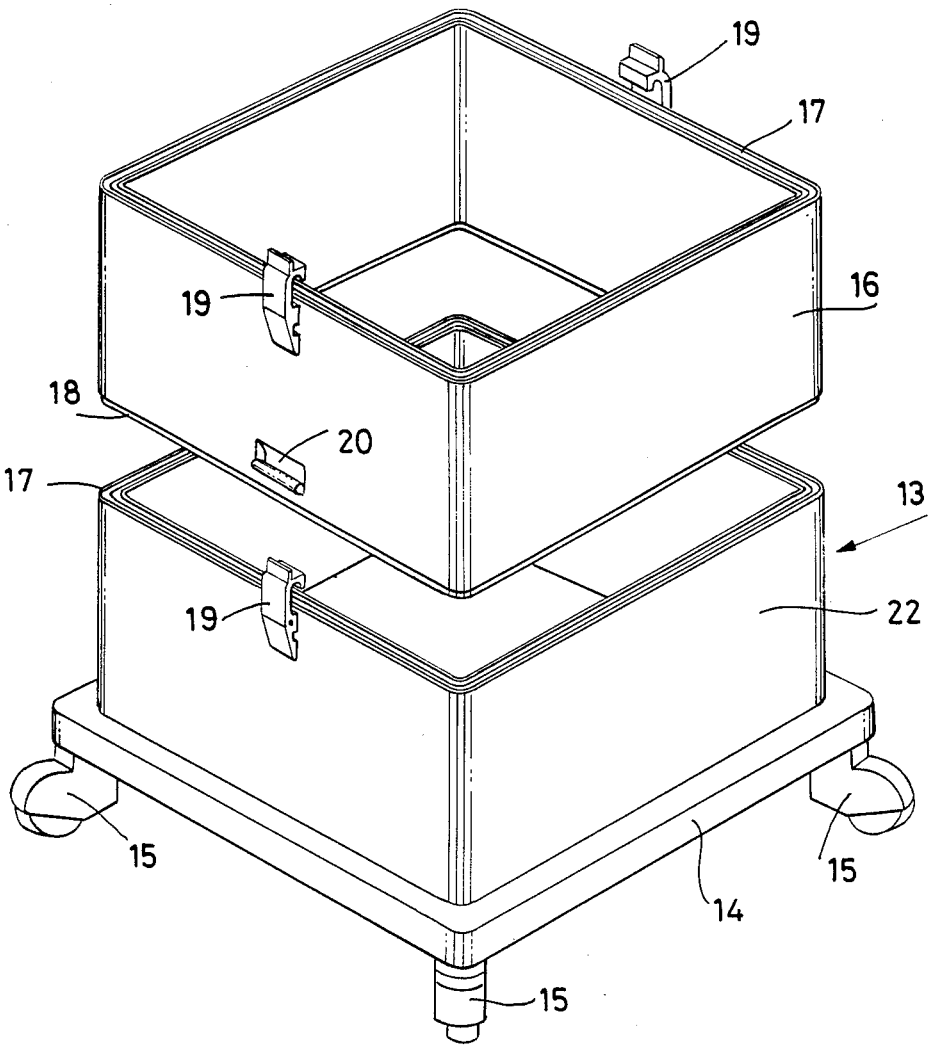
FIG. 2 shows a schematic perspective view of a bin used in the aspirator of FIG. 1.

With reference to the figures, an aspirator 10 for solid or liquid substances, applying the innovatory principles of this invention, comprises a head 11 carrying the suction device 12 and a suction hose 21, made according to the known technique and therefore not described in detail, and a bin composed of a bottom section 13 comprising a vertical-walled perimeter 22 and a bottom 14 carrying on its lower surface a plurality of caster wheels 15, and one or more intermediate sections 16 open from below and above. The edges of the apertures of the bottom section and intermediate sections are shaped in such a way as to adapt to one another, in the sense that they can be stacked one on top of the other to form a bin with connecting walls, the resulting upper open end of which can receive the head 11 so as to form the complete aspirator as can be seen in FIG. 1. As can be clearly seen in the same figure, the watertight coupling between the various sections making up the bin and between the upper section and the head 11 is achieved by suitably shaping the contacting edges. For example, (FIG. 2) the upper edges of the sections are provided with a groove 17 and the lower edges and the suction head are provided with a ledge 18 specular thereto.

To ensure that the sections are firmly and securely clamped together, and at the same easily detached, each section is provided externally with clamps, close to the upper edge, for example toggle clamps 19, represented in FIG. 1 by a continuous line in their closed position and by a dotted line in their open position. Said clamps 19 engage with corresponding notches 20 disposed externally and adjacent to the lower end of the intermediate sections and of the head 11.

The utilization of an aspirator using the innovatory principles of this invention will appear clearly evident from the foregoing description.

Due to the modularity of the sections making up the bin of the aspirator it is possible to obtain any desired capacity of the latter by simply adding or removing intermediate sections.

For example, to obtain an aspirator of minimum capacity and, therefore of minimum overall dimensions, it is sufficient to fit the suction head 11 directly onto the bottom section 13, thereby eliminating, with respect to the embodiment shown in the accompanying drawings, the central section 16. In order to obtain an aspirator of greater capacity, it is sufficient to add one or more intermediate sections 16, fitting the suction head 11 onto the upper end of the last one. It is thus possible to produce a standard set of parts (bottom sections 13 and intermediate sections 16) instead of numerous bins of different capacity, thereby simplifying the production, storage and distribution of the aspirators.

The shape of the sections and of the suction head shown herein is obviously given merely by way of example and may be square, rectangular or circular; for example, it is also possible to produce a series of intermediate sections of various heights, so that the bin capacities are not only obtained by fitting together several identical intermediate sections but also simply by using only one intermediate section greater or smaller in height.

Likewise, the type and shape of the fasteners and the coupling edges between the various sections and between the latter and the suction head is also given herein merely by way of example. Any other shape and design of known technique achieving the scope is equally feasible without, however, deviating from the sphere of this invention. For example, the coupling and the fastening may be achieved by means of joints, screws, etc., as can be easily imagined by anyone expert in the art.

What is claimed:

1. In an aspirator for solid and liquid substances, of the type comprising a head supporting thereon an electric motor-driven suction device, said head being removably fitted onto the open upper end of a wheel-mounted bin, and a suction hose communicating with the inside of said bin, the improvement characterized by the fact that said bin comprises a bottom section carrying wheels on its undersurface, one or more intermediate sections, open from above and below, and stacked and removably secured together and to said bottom section, and coupling means for releasably connecting said sections together to form said bin, a plurality of latching notches formed in said head and said intermediate sections, and said coupling means being in the form of a plurality of fasteners, disposed externally of and adjacent to one edge of each of said sections, and each of said fasteners being movable from a first open position to a second closed position by fitting into a corresponding one of said notches in said intermediate sections and said head, respectively.

2. An aspirator as claimed in claim 1, characterized by the fact that the contacting edges of the various sections and of the suction head comprise watertight means for securing the various sections forming the bin, said watertight means being achieved by the presence in the pairs of mutually contacting edges of a groove in one edge and a ledge specular thereto in the other.

* * * * *